US011605512B2

(12) United States Patent
Hou et al.

(10) Patent No.: US 11,605,512 B2
(45) Date of Patent: Mar. 14, 2023

(54) LIFTING MECHANISM AND KEY STRUCTURE USING THE SAME

(71) Applicant: Darfon Electronics Corp., Taoyuan (TW)

(72) Inventors: Po-Chun Hou, Taoyuan (TW); Chin-Hung Lin, Taoyuan (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 17/717,287

(22) Filed: Apr. 11, 2022

(65) Prior Publication Data

US 2022/0336165 A1 Oct. 20, 2022

(30) Foreign Application Priority Data

Apr. 15, 2021 (TW) ..... 110113646

(51) Int. Cl.

| | |
|---|---|
| ***H01H 3/12*** | (2006.01) |
| ***H01H 13/14*** | (2006.01) |
| ***H01H 13/10*** | (2006.01) |
| ***H01H 13/20*** | (2006.01) |

(52) U.S. Cl.

CPC ..... *H01H 13/14* (2013.01); *H01H 13/10* (2013.01); *H01H 13/20* (2013.01); *H01H 2233/07* (2013.01)

(58) Field of Classification Search

CPC ..... H01H 3/125; H01H 13/705; H01H 13/14; H01H 13/70; H01H 13/704; H01H 13/7065; H01H 13/7006; H01H 13/7057; H01H 13/78; H01H 13/79; H01H 13/52; H01H 13/703; H01H 13/507

See application file for complete search history.

(56) References Cited

U.S. PATENT DOCUMENTS 5,850,194 A * 12/1998 Lin ..... H01H 3/125 200/344
6,064,020 A 5/2000 Yamada et al.
6,559,399 B2 5/2003 Hsu et al.
(Continued)

FOREIGN PATENT DOCUMENTS

CN 202662496 U 1/2013
CN 106971889 B 1/2019
(Continued)

OTHER PUBLICATIONS

Office action of counterpart application by Taiwan IP Office dated Nov. 25, 2021.

*Primary Examiner* — Ahmed M Saeed

(57) ABSTRACT

A key structure is provided. The key structure includes a base plate, a key cap and a lifting mechanism is provided. The base plate includes a first bottom wall. The key cap is disposed opposite to the base plate and includes a first cap wall. The lifting mechanism is movably connected between the key cap and the base plate, so that the key cap could reciprocate with respect to the base plate. The lifting mechanism includes a first lower shaft portion and a first upper shaft portion, which are respectively movably connected on the same side of the key cap and the base plate. When the key cap is in a released state, the first upper shaft portion presses against the first cap wall, but the first lower shaft portion is separated from the bottom wall by a maintaining gap.

13 Claims, 7 Drawing Sheets

(56) References Cited

U.S. PATENT DOCUMENTS

| | | | | |
|---|---|---|---|---|
| 6,781,077 | B2 * | 8/2004 | Olodort ..... | H01H 3/125<br>200/344 |
| 10,283,289 | B2 | 5/2019 | Chen et al. | |
| 10,672,570 | B2 | 6/2020 | Chen et al. | |
| 10,685,791 | B2 | 6/2020 | Wu | |

FOREIGN PATENT DOCUMENTS

| | | | |
|---|---|---|---|
| CN | 110189948 | A | 8/2019 |
| TW | 201322293 | A | 6/2013 |
| TW | 201715548 | A | 5/2017 |
| TW | M595879 | U | 5/2020 |

* cited by examiner

LIFTING MECHANISM AND KEY STRUCTURE USING THE SAME

This application claims the benefit of Taiwan application Serial No. 110113646, filed Apr. 15, 2021, the subject matter of which is incorporated herein by reference.

BACKGROUND OF THE INVENTION

Field of the Invention

The invention relates in general to a lifting mechanism and a key structure using the same, and more particularly to a lifting mechanism whose lower shaft portion is separated from a bottom wall of a base plate by a maintaining gap and a key structure using the same.

Description of the Related Art

A conventional key structure includes a key cap, a lifting mechanism and a base plate. To adopt an automated assembly, the lifting mechanism must first be assembled and connected to the base plate, and then the key cap assembly is connected to the lifting mechanism on the base plate, so that the lifting mechanism could be connected to the key cap and the base plate. However, after several years of thinning trend in electronic devices, the size of the connection parts between the key cap, the lifting mechanism and the base plate could be reduced no more. Moreover, the automated assembly of the lifting mechanism relates to many design requirements and complicated factors. For example, the height control of the key cap needs to be accurate and precise, the upward/downward lifting of the key cap must not be skewed, pullout resistance needs to be provided between the lifting mechanism and the base plate, the lifting mechanism cannot be detached, and the structure of the lifting mechanism cannot be damaged or deformed. These design requirements and factors affect the structural strength and operation of the key as well as the actions, procedures, schedules and capacity of the automated assembly. Particularly, the abrasion loss generated between the lifting mechanism and the base plate during the assembly process will change the predetermined lifting stroke of the key structure, making the height control of the key inaccurate. Therefore, it has become a prominent task for the industries to provide a key structure, which has suitable design and is capable of resolving the above problems encountered in the prior art.

SUMMARY OF THE INVENTION

The invention is directed to a key structure capable of resolving the problems encountered in the prior art.

According to one embodiment of the present invention, a key structure is provided. The key structure includes a base plate, a key cap and a lifting mechanism is provided. The base plate includes a first bottom wall. The key cap is disposed opposite to the base plate and includes a first cap wall. The lifting mechanism is movably connected between the key cap and the base plate, so that the key cap could reciprocate with respect to the base plate. The lifting mechanism includes a first lower shaft portion and a first upper shaft portion, which are respectively movably connected on the same side of the key cap and the base plate. When the key cap is in a released state, the first upper shaft portion presses against the first cap wall, but the first lower shaft portion is separated from the bottom wall by a maintaining gap.

According to another embodiment of the present invention, a lifting mechanism is provided. The lifting mechanism is movably connected between a key cap and a base plate, so that the key cap could reciprocate with respect to the base plate. The lifting mechanism includes a pair of brackets relatively movable to each other. The pair of brackets includes a first upper shaft portion and a first lower shaft portion, which are respectively movably connected on the same side of the key cap and the base plate. When the key cap is in a released state, the first upper shaft portion presses against a first cap wall of the key cap, but the first lower shaft portion is separated from a first bottom wall of the base plate by a maintaining gap.

The above and other aspects of the invention will become better understood with regard to the following detailed description of the preferred but non-limiting embodiment (s). The following description is made with reference to the accompanying drawings.

DETAILED DESCRIPTION OF THE INVENTION

Figure 1:
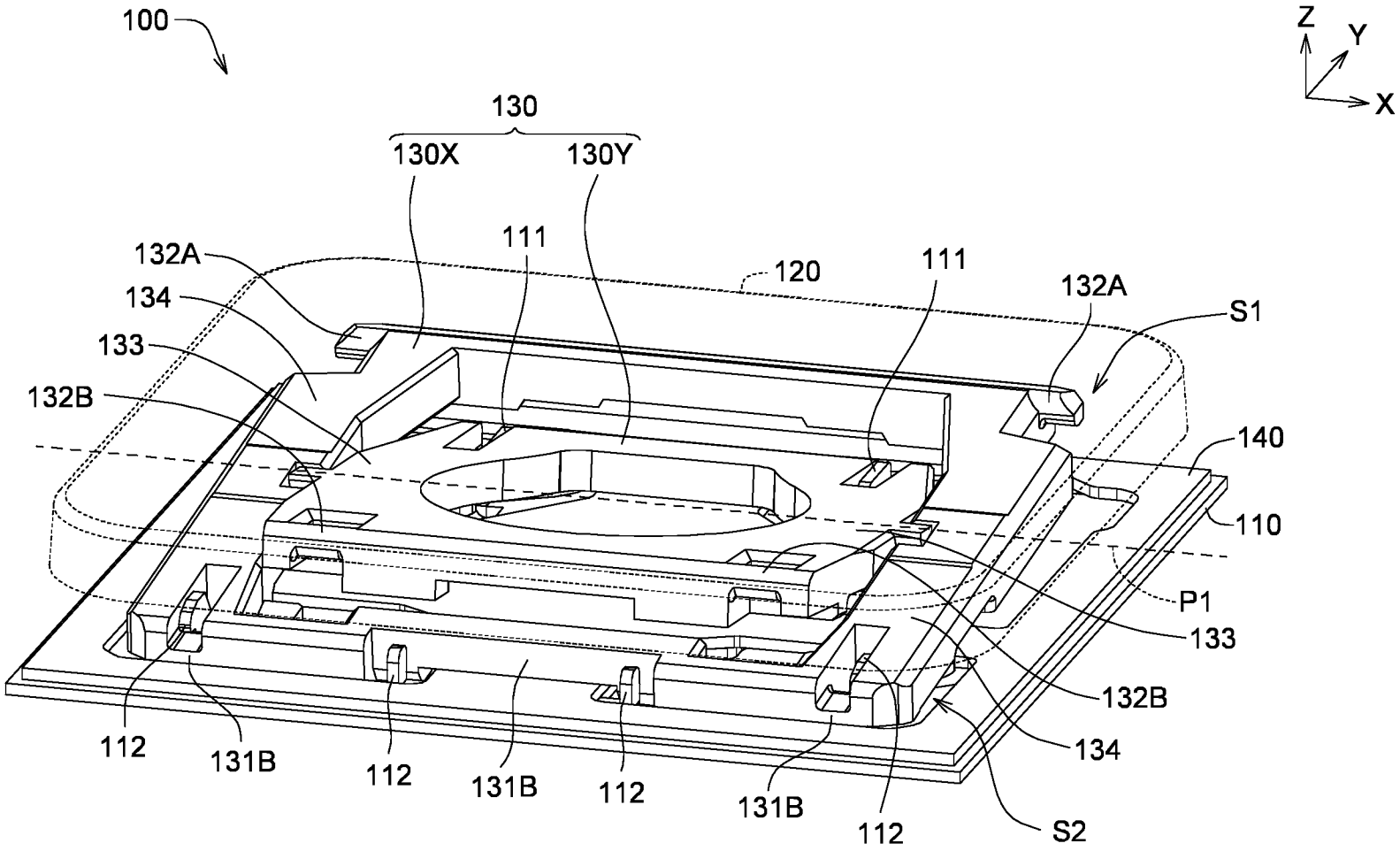
FIG. 1 is an assembly diagram of a key structure in a released state according to an embodiment of the present invention.
Figure 2:
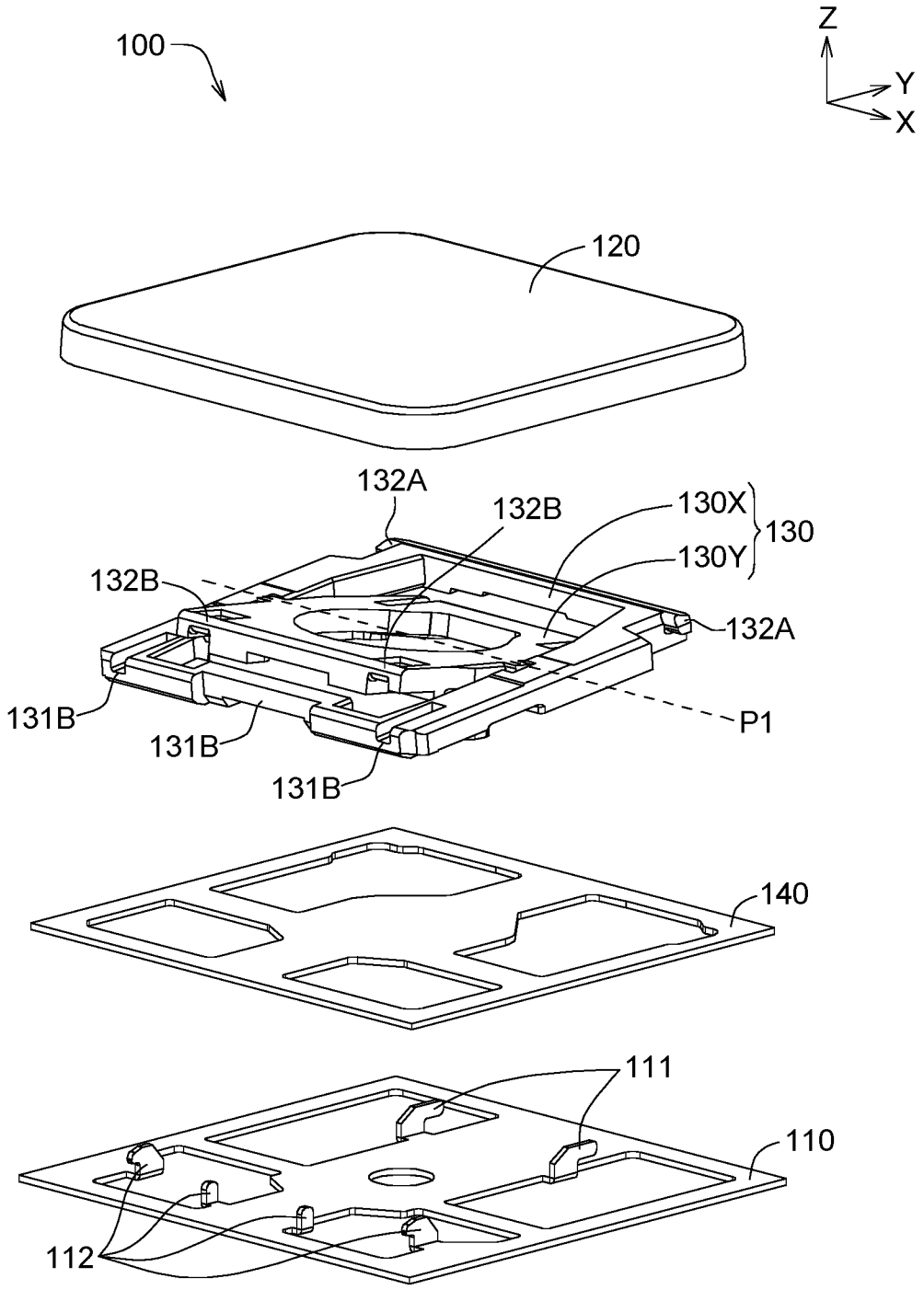
FIGS. 2 and 3 are explosion diagrams of the key structure of FIG. 1 at different view angles.
Figure 3:
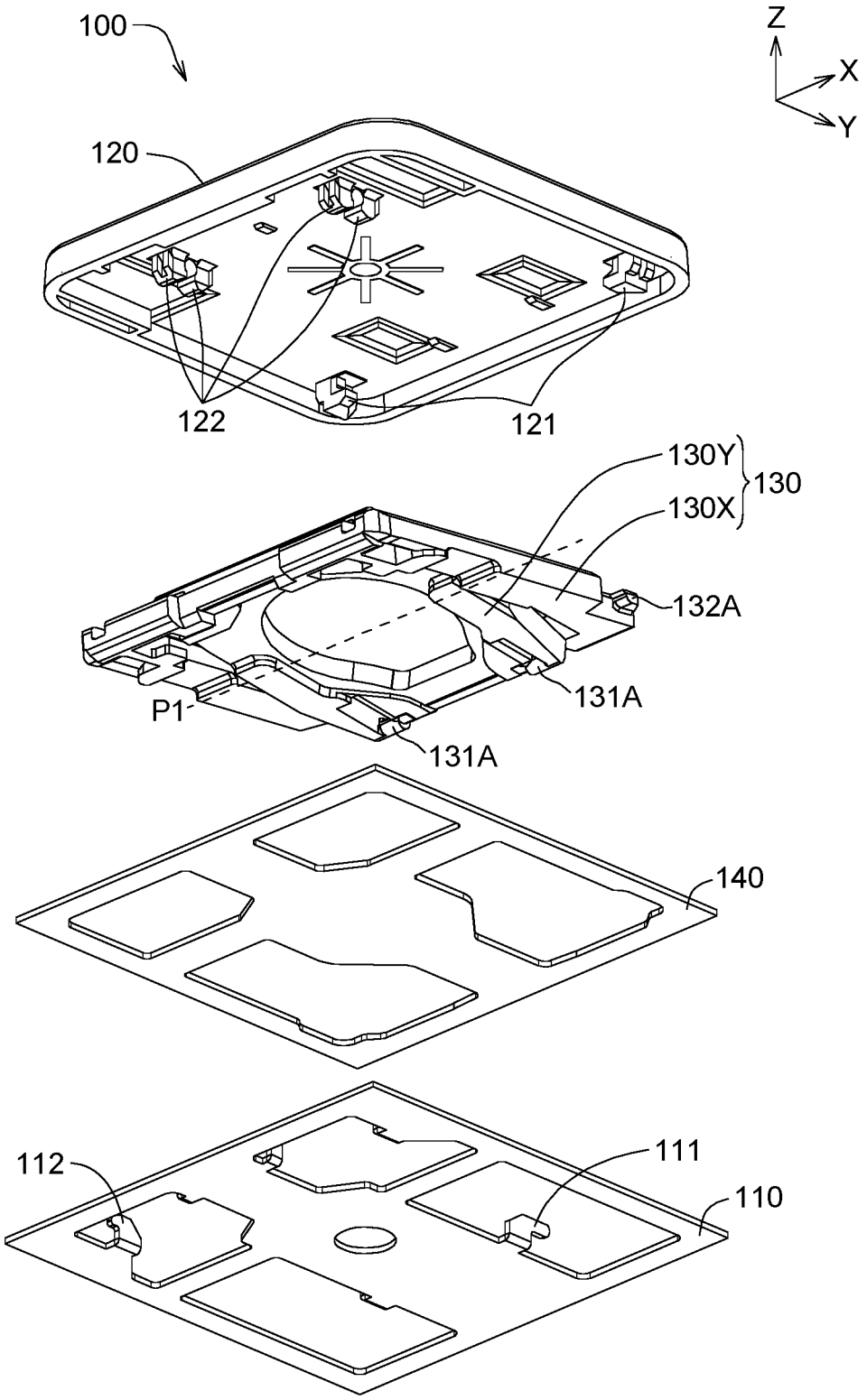
Figure 4:
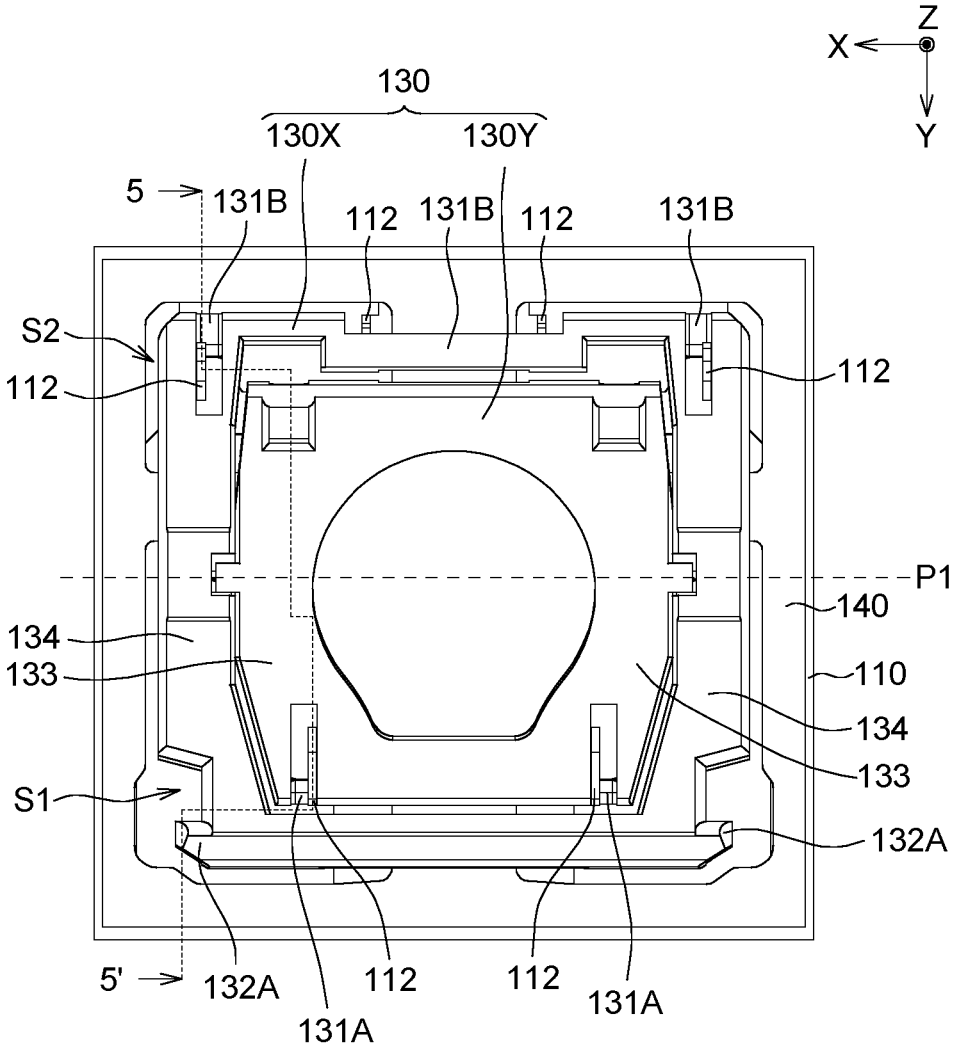
FIG. 4 is a top view of the key structure (not illustrated the key cap) of FIG. 1.
Figure 5:
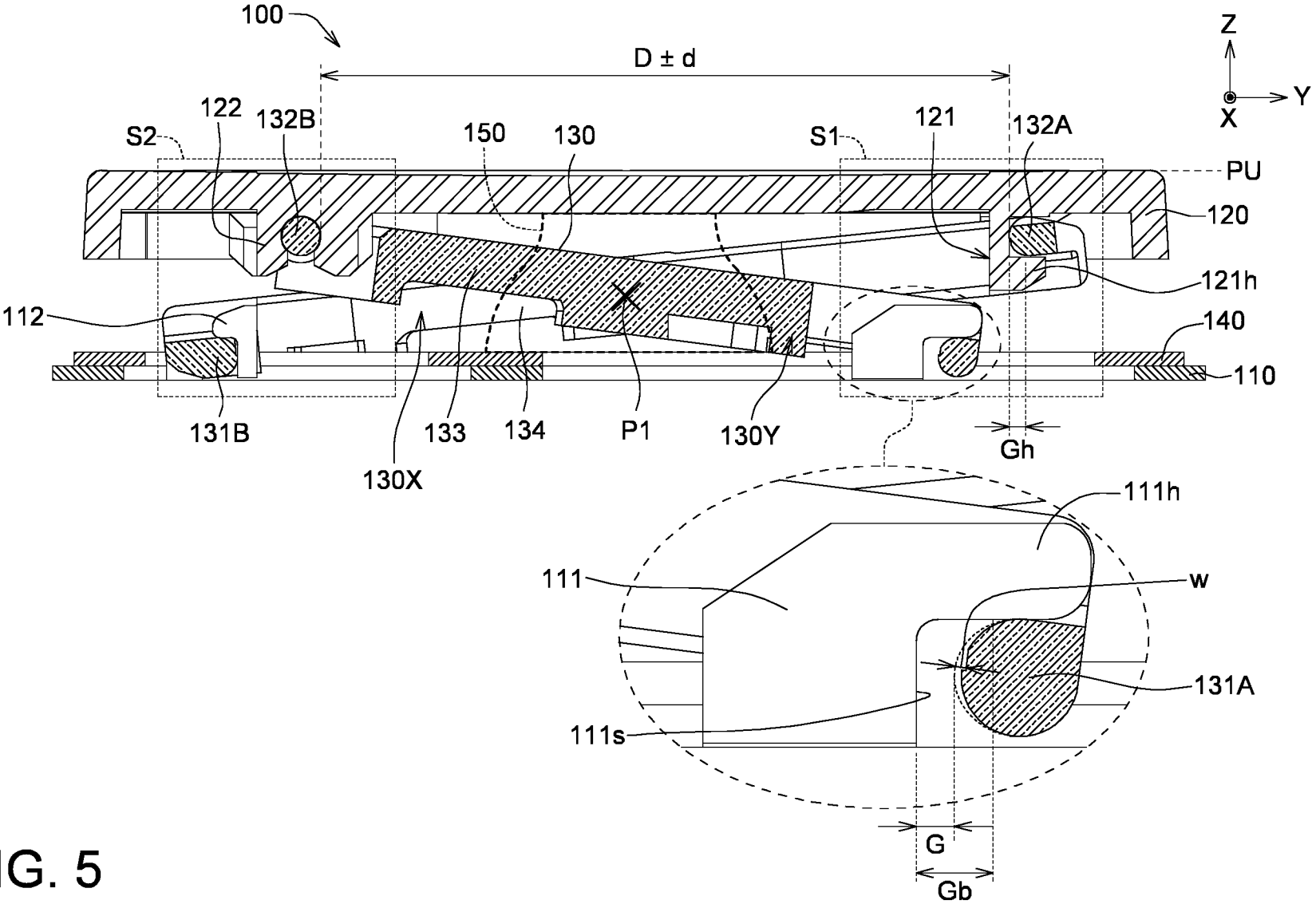
FIG. 5 is a cross-sectional view of the key structure of FIG. 4 along direction 5-5'.
Figure 6:
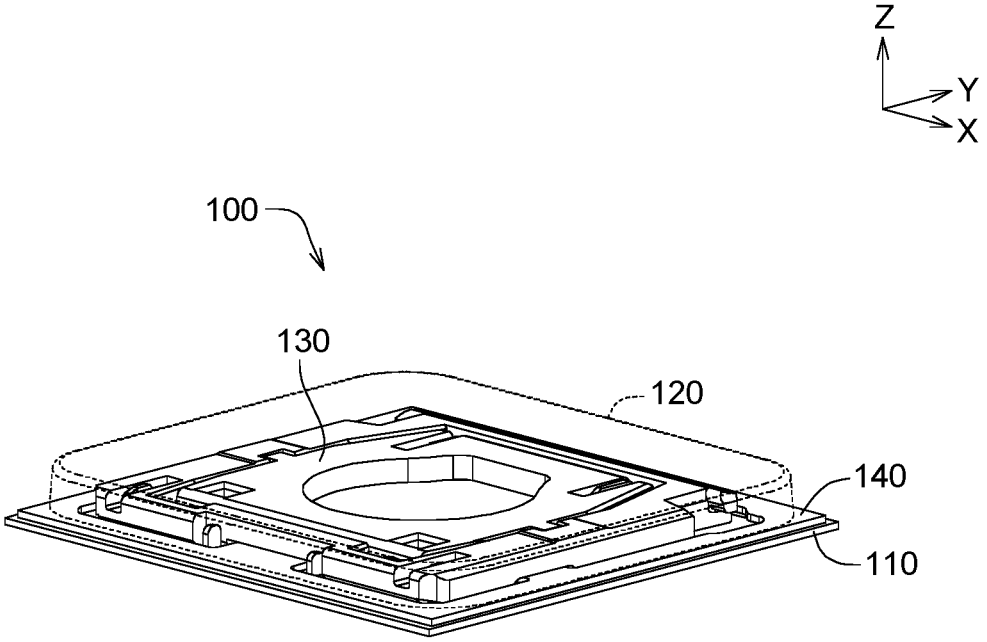
FIG. 6 is an assembly diagram of the key structure of FIG. 1 in a pressed state.
Figure 7:
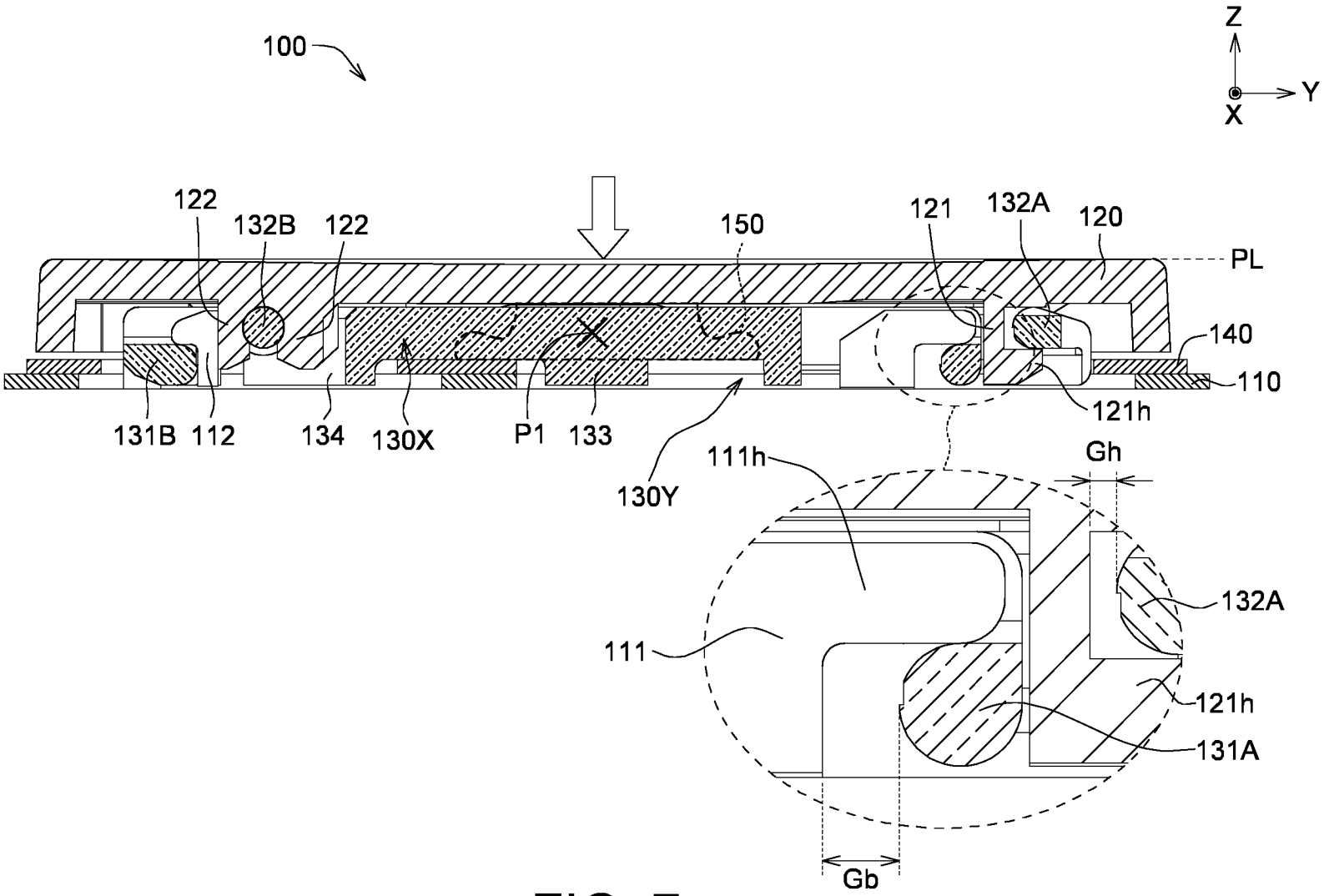
FIG. 7 is a cross-sectional view of the key structure of FIG. 6.

Refer to FIGS. 1 to 7. FIGS. 1 to 5 are schematic diagrams of a key structure 100 in a released state according to an embodiment of the present invention. FIGS. 6 to 7 are schematic diagrams of a key structure 100 of FIG. 1 in a pressed state. FIG. 1 is an assembly diagram of a key structure 100 in a released state according to an embodiment of the present invention. FIGS. 2 and 3 are explosion diagrams of the key structure 100 of FIG. 1 at different view angles. FIG. 4 is a top view of the key structure 100 of FIG. 1 (the key cap 120 is not illustrated). FIG. 5 is a cross-sectional view of the key structure 100 of FIG. 4 along direction 5-5'. FIG. 6 is an assembly diagram of the key structure 100 of FIG. 1 in a pressed state. FIG. 7 is a cross-sectional view of the key structure 100 of FIG. 6.

As indicated in FIGS. 1 to 3 and 5, the key structure 100 includes a base plate 110, a key cap 120, a lifting mechanism 130, an elastomer 150 (FIG. 5) and a thin-film layer 140. The key cap 120 is disposed opposite to the base plate 110. The lifting mechanism 130 is movably connected between the key cap 120 and the base plate 110, so that the key cap 120 could reciprocate with respect to the base plate 110. Although it is not illustrated in the diagram, the key structure 100 further includes an elastomer 150 (FIG. 5), which is disposed between the key cap 120 and the base plate 110 and passes through the lifting mechanism 130. When the key cap 120 is in a pressed state (at the lower limit position PL of FIG. 7), the elastomer 150 is deformed to store an elastic potential energy. After the key cap 120 is released, the elastomer 150 releases the elastic potential energy to restore the key cap 120 to a released state (the upper limit position PU of FIG. 5). The thin-film layer 140 is disposed on the base plate 110. The thin-film layer 140 includes at least a switch (not illustrated). When the key cap 120 is in the pressed state, the elastomer 150 triggers a switch of the thin-film layer 140 to emit a triggering signal. On receiving the triggering signal, the processor (not illustrated) performs a corresponding function.

Each embodiment of the present invention mainly relates to the adjustment of the height control structure of the key cap 120. The height of the key cap refers to the height of the key cap 120 at the highest position relative to the base plate 110 when the key structure 100 and the key cap 120 are in a released state. The so called "height control" refers to redesigning the element structure of the key structure 100 to control the highest position of the key cap 120 during the lifting stroke. When the key cap 120 reaches the highest position, the scissor-type lifting mechanism 130 is also expanded to reach the highest point. Nonetheless, due to the design complexity, it is very important to understand the inventive ideas of the embodiment of the present invention.

Firstly, the base plate 110 processed with metal machining has higher precision and accuracy, and the connection parts of the base plate 110 are generally used in the design of a height control mechanism. Moreover, when the key cap 120 changes to the pressed state from the released state, the two interconnected brackets of the scissor-type lifting mechanism 130 (the two interconnected brackets respectively are outer bracket 130X and inner bracket 130Y) ensure that the key cap 120 could be stably lifted upwards and downwards. The connection parts between the base plate 110 and the key cap 120 need to firmly grasp the shaft of the lifting mechanism 130 (the shaft is such as the second lower shaft portion 131B, the first lower shaft portion 131A, the first upper shaft portion 132A and the second upper shaft portion 132B) to avoid the shaft coming off the lifting mechanism 130 and also assure that the shaft of the lifting mechanism 130 has sufficient allowance for rotation and/or translation during the lifting stroke. In the automatic assembly process, to increase the bonding strength between the lifting mechanism 130 and the key cap 120 and the base plate 110 respectively, reduce the assembly gap, and increase the assembly speed, assembly interference could be prioritized. However, assembly interference also makes the plastic brackets 130X and 130Y being cut and damaged by the edge of the connection parts of the metal base plate 110 and form a new element gap. Thus, to implement the height control mechanism using the connection parts of the base plate 110 according to the prior art, the problem of element gap being generated on the base plate 110 must be resolved together.

In view of the cross-sectional view, such as FIG. 5, the scissor-type lifting mechanism 130 is an X-shaped structure with central pivoting. For enabling the key cap 120 to move stably during the lifting stroke, the four junctions, namely the top right junction, the top left junction, the bottom right junction and the bottom left junction, through which the X-shaped structure of the lifting mechanism 130 is connected to the key cap 120 and the base plate 110 respectively, normally require 2 rotation sides and 2 sliding sides. According to an exemplary embodiment of the present invention, the best of the four junctions is selected as a sliding side and used in the design of the height control mechanism. As disclosed above, to implement the height control mechanism using the connection parts of the base plate 110 according to the prior art, the problem of element gap being generated on the base plate 110 must be resolved together. However, as the trend in the design of the key is directed towards thinness, the highest points of the key cap 120 and the lifting mechanism 130 are getting lower and lower, so that the conventional design will encounter new problems. As indicated in FIG. 5, suppose the first bottom wall 111 at the bottom right corner is selected and used as a height control mechanism. To resolve the abovementioned problem of element gap caused by assembly interference and element damage, an additional constraint structure needs to be extended from the base plate 110 to block the second lower shaft portion 131B of the lifting mechanism 130 at a further rightward position, so that the highest points of the key cap 120 and the lifting mechanism 130 could be maintained at an even lower position. Given that the first bottom wall 111 is located on the inner side of the inner bracket 130Y, when the assembly interference is considered, the length of the lateral hook segment 111*h* of the L-shaped hook portion cannot be too long otherwise the lateral hook segment 111*h* might interfere with the outer bracket 130X; due to the design requirements of reducing the thickness and height of the key, the lateral hook segment 111*h* of the first bottom wall 111 will be too short, the sliding space of the first lower shaft portion 131A will be insufficient, and the first lower shaft portion 131A may easily come off the lateral hook segment 111*h* of the first bottom wall 111. Or, in the multi-variate system, if the machining constraints of the first bottom wall 111 and the sliding space of the first lower shaft portion 131A are valued to assure that the lateral hook segment 111*h* of the first bottom wall 111 has a sufficient strength, then the assembly interference will generate an excessive amount of interference, elements will be damaged and the gap will be too large, making the height control of the key inaccurate. Thus, the additional constraint structure of the base plate 110 needs to move further rightwards, making the first lower shaft portion 131A or the lateral hook segment 111*h* of the first bottom wall 111 possibly interfere with the outer bracket 130X, or the sliding space of the first lower shaft portion 131A is insufficient for the key cap 120 to be completely pressed and reach the lowest point.

According to the embodiment of the present invention, the sliding side of two junctions through which the lifting mechanism 130 and the key cap 120 are connected is selected as the target structure of height control, so that factors such as assembly interference, element damage and element gap will not cause unnecessary interference to height control, and the problem of inaccurate height control caused by assembly interference, element damage and element gap will be resolved.

As indicated in FIGS. 1 to 5, the lifting mechanism 130 includes a pair of brackets relatively movable to each other, wherein the pair of brackets includes an inner bracket 130Y and an outer bracket 130X surrounding the inner bracket 130Y. The pair of brackets 130X and 130Y includes a first lower shaft portion 131A, a first upper shaft portion 132A, a second lower shaft portion 131B and a second upper shaft portion 132B. The first upper shaft portion 132A and the second lower shaft portion 131B are located on the outer bracket 130X; the second upper shaft portion 132B and the first lower shaft portion 131A are located on the inner bracket 130Y. In an embodiment, the lifting mechanism 130 further includes a pair of inner lateral arms 133 and a pair of outer lateral arms 134. The first upper shaft portion 132A and the second lower shaft portion 131B are located on two opposite sides between a pair of outer lateral arms 134 to form a complete outer bracket 130X. The second upper shaft portion 132B and the first lower shaft portion 131A are located on two opposite sides between a pair of inner lateral arms 133 to form a complete inner bracket 130Y. Besides, the inner lateral arm 133 and the outer lateral arm 134 are pivotally connected in a pivotal direction P1 (the pivotal direction P1 is illustrated in FIG. 1). In an embodiment, the inner lateral arm 133 and the outer lateral arm 134 are pivotally connected by way of rotation. For example, the first lower shaft portion 131A and the first upper shaft portion 132A are located on the first side S1 of the pivotal direction P1, and the second lower shaft portion 131B and the second upper shaft portion 132B are located on the second side S2 of the pivotal direction P1, wherein the first side S1 and the second side S2 respectively are two opposite sides of the pivotal direction P1.

The key cap 120 further includes at least a pair of second cap walls 122. The second upper shaft portion 132B of the lifting mechanism 130 is located on the other side of the inner bracket 130Y (the second side S2) opposite to the first lower shaft portion 131A; the second upper shaft portion 132B is clamped by two second cap walls 122 to be pivotally connected to the key cap 120, so that the second upper shaft portion 132B becomes the rotation side of the lifting mechanism 130 in the direction of the key cap 120. The base plate 110 further includes one or more second bottom walls 112 (FIGS. 1, 2, 3 and 5); the second lower shaft portion 131B of the lifting mechanism 130 is located on the other side of the outer bracket 130X (the second side S2) opposite to the first upper shaft portion 132A. The second lower shaft portion 131B is clamped by at least two second bottom wall 112 to be pivotally connected to the base plate 110, so that the second lower shaft portion 131B becomes the rotation side of the lifting mechanism 130 in the direction of the base plate 110.

During the assembly process of the base plate 110 and the lifting mechanism 130, the second lower shaft portion 131B of the lifting mechanism 130 is firstly bucked to the second bottom wall 112 of the base plate 110, then the lifting mechanism 130 rotates around the second bottom wall 112 until the first lower shaft portion 131A is buckled to the first bottom wall 111. In an embodiment, the hardness of the first bottom wall 111 is greater than the hardness of the first lower shaft portion 131A of the lifting mechanism 130. In terms of material, the base plate 110 is made of metal such as stainless steel or alloy; the lifting mechanism 130 is formed of polymer such as plastics or synthetic resin. Since the hardness of the first bottom wall 111 is greater than the hardness of the first lower shaft portion 131A, during the buckling process of the first lower shaft portion 131A and the first bottom wall 111, the side of the first lower shaft portion 131A facing the lateral hook segment 111*h* of the first bottom wall 111 will have an abrasion loss w. According to the embodiment of the present invention, the first lower shaft portion 131A and the first bottom wall 111 in a released state are separated from each other (do not press each other), therefore the abrasion loss w does not affect the lifting stroke of the key cap 120. Certainly, the lifting mechanism 130 could adopt vertical assembly. When the second lower shaft portion 131B is buckled to the second bottom wall 112 of the base plate 110, the first lower shaft portion 131A will also have abrasion loss w when interfering with the assembly of the lateral hook segment 111*h* of the first bottom wall 111.

The height control mechanism of the key cap 120 mainly relates to the connection parts connecting the lifting mechanism 130 to the key cap 120 and the base plate 110. Refer to FIGS. 1 to 5. The base plate 110 includes a first bottom wall 111; the key cap 120 includes at least a first cap wall 121. The first upper shaft portion 132A and the first lower shaft portion 131A of the scissor-type lifting mechanism 130 are respectively movably connected on the same side of the key cap 120 and the base plate 110, wherein the same side is such as the first side S1 (that is, the first lower shaft portion 131A of the scissor-type lifting mechanism 130 is movably connected on the first side S1 of the base plate 110, and the first upper shaft portion 132A is movably connected on the first side S1 of the key cap 120); the first lower shaft portion 131A and the first upper shaft portion 132A both are used as a sliding side. Relatively, on the second side S2, the lifting mechanism 130 includes a second lower shaft portion 131B and a second upper shaft portion 132B, which are used as rotation sides. Refer to FIGS. 6 to 7. When the key cap 120 is in the pressed state and located at the lowest point (for example, at the lower limit position PL of FIG. 7), the first lower shaft portion 131A is separated from the bottom wall 111 by a bottom wall gap Gb, the first upper shaft portion 132A is separated from the first cap wall 121 by a cap wall gap Gh, and the cap wall gap Gh is smaller than the bottom wall gap Gb. The cap wall gap Gh relates to the range within which the first upper shaft portion 132A could slide on the inner edge of the horizontal segment 121*h* of the first cap wall 121; the bottom wall gap Gb relates to the range within which the first lower shaft portion 131A could slide on the inner edge of lateral hook segment 111*h* of the first bottom wall 111. In other words, the distance, within which the first upper shaft portion 132A limited by the first cap wall 121 could slide, is smaller than the distance, within which the first lower shaft portion 131A limited by the first bottom wall 111 could slide.

Refer to FIGS. 1 to 5 with reference to FIGS. 6 to 7. When the key cap 120 is changing to a released state (that is, moving towards the upper limit position PU where the key cap 120 is at the highest point) from a pressed state (as indicated in FIG. 7, meanwhile, the key cap 120 is located at the lower limit position PL being the lowest point), the second lower shaft portion 131B and the second upper shaft portion 132B are used as rotation sides and do not move (for example, do not translate), and the first lower shaft portion 131A and the first upper shaft portion 132A, which are used as sliding sides, gradually move inwardly (move leftward as indicated in FIGS. 5 and 7). Since the cap wall gap Gh between the first upper shaft portion 132A and the first cap wall 121 is reduced, the first upper shaft portion 132A presses against the first cap wall 121 only when the first lower shaft portion 131A is separated from the bottom wall 111 by a maintaining gap G. Meanwhile, the key cap 120 reaches the upper limit position PU being the highest point. In practice, the maintaining gap G could be designed to approach the difference between the cap wall gap Gh and the bottom wall gap Gb.

When the key cap 120 is in a released state (as indicated in FIG. 5), that is, when the key cap 120 reaches the upper limit position PU, the key structure 100 and the lifting mechanism 130 are completely expanded upwards. Since the first lower shaft portion 131A is separated from the bottom wall 111 by a maintaining gap G, even when the first lower shaft portion 131A has a slight abrasion loss w, the maintaining gap G is far greater than the abrasion loss w, therefore the first lower shaft portion 131A will not be interfered with or limited by the first bottom wall 111. Thus, actual lifting stroke of the key cap 120 could meet the requirement of predetermined lifting stroke (here, the predetermined lifting stroke refers to the lifting stroke without considering the abrasion loss).

Although the plastic key cap 120 is normally formed using a mold and will generate a certain amount of tolerance d, the tolerance d does not affect the abovementioned height control of the key cap. As indicated in FIG. 5, the tolerance d of the distance D between the first cap wall 121 and the second cap wall 122 is smaller than the abrasion loss w of the first lower shaft portion 131A. The tolerance d could be a manufacturing tolerance and/or an assembly tolerance. The tolerance d is smaller than the abrasion loss w of the first lower shaft portion 131A; the maintaining gap G is greater than the absolute value of the tolerance d. In comparison to the abrasion loss w, the tolerance d has a smaller influence (amount of change) on the lifting stroke. Moreover, even when the tolerance d is generated during the manufacturing process of the key cap 120, since the predetermined maintaining gap G is greater than the absolute value of the tolerance d, the bottom wall gap Gb will not be greater than the cap wall gap Gh. That is, the damaged first lower shaft portion 131A will not be limited by the first bottom wall 111 in advance, making the highest point of the key cap 120 erroneously arranged. In an embodiment, the tolerance d is such as 0.03 millimeters, and the abrasion loss w is such as 0.05 millimeters. However, the value of the tolerance d and/or the value of the abrasion loss w depend on actual needs and are not subjected to specific restrictions in the embodiment of the present invention.

In an embodiment, the first upper shaft portion 132A of the lifting mechanism 130 and the first cap wall 121 of the key cap 120 are formed of the same material, such as polymer like plastics. Since the first upper shaft portion 132A and the first cap wall 121 are formed of the same material, when the first upper shaft portion 132A is bucked to the first cap wall 121, the first upper shaft portion 132A and the first cap wall 121 are merely deformed and generate no abrasion or only a slight abrasion loss. This slight abrasion loss (if any) is unable to change the lifting stroke of the key cap 120.

In above embodiments as indicated in FIG. 5, the outer bracket 130X and the first cap wall 121 limit each other on the sliding side (that is, the first upper shaft portion 132A) in the direction of the key cap 120, so that the outer bracket 130X controls the height of the key cap 120. In another embodiment, the other end of the inner bracket 130Y in the direction of the key cap 120 (that is, the second upper shaft portion 132B) is used as a sliding side on which the inner bracket 130Y and the second cap wall 122 limit each other (the second cap wall 122 changes to an L-shaped structure of the first cap wall 121), so that the inner bracket 130Y controls the height of the key cap 120.

Although in the above embodiments, the first upper shaft portion 132A of the outer bracket 130X and the first cap wall 121, the first lower shaft portion 131A of the inner bracket 130Y and the first bottom wall 111 are used as sliding sides, in other embodiments the arrangement could be reversed. That is, the first upper shaft portion could belong to the end of the inner bracket close to the key cap, the first cap wall could also belong to the first upper shaft portion of the key cap corresponding to the inner bracket. Similarly, the first lower shaft portion could belong to the end of the outer bracket close to the base plate, and the first bottom wall also could belong to the first lower shaft portion of the base plate corresponding to the outer bracket. That is, in terms of the scissor-type lifting mechanism, as long as a pair of sliding sides is arranged on the same side, and the sliding side of the key cap is used in the height control mechanism, desired effects of the inventive ideas of the present invention will be achieved.

To summarize, a key structure is provided according to the embodiment of the present invention. The key structure includes a key cap, a lifting mechanism and a base plate. When the key cap is in a released state, the lower shaft portion of the lifting mechanism is separated from the bottom wall of the base plate by a maintaining gap. Thus, even when the lower shaft portion has an abrasion loss, the abrasion loss will not affect the predetermined lifting stroke of the key cap and the height of the key because the lower shaft portion and the bottom wall in a released state are separated from each other. Therefore, the key structure of the embodiment of the present invention particularly meets the design requirements of the thinned key with a shorter stroke.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A key structure, comprising: a base plate comprising a first bottom wall; a key cap disposed opposite to the base plate and comprising a first cap wall; a lifting mechanism movably connected between the key cap and the base plate, so that the key cap reciprocates with respect to the base plate, wherein the lifting mechanism comprises a first lower shaft portion and a first upper shaft portion which are respectively movably connected on the same side of the base plate and the key cap; wherein when the key cap is in a released state, the first upper shaft portion presses against the first cap wall, but the first lower shaft portion is separated from the first bottom wall by a maintaining gap; wherein in a pressed state, the first lower shaft portion is separated from the first bottom wall by a bottom wall gap, the first upper shaft portion is separated from the first cap wall by a cap wall gap, and the cap wall gap is smaller than the bottom wall gap.

2. The key structure according to claim 1, wherein the lifting mechanism comprises an inner lateral arm and an outer lateral arm which are pivotally connected in a pivotal direction; the first lower shaft portion and the first upper shaft portion are located on the same side of the pivotal direction.

3. The key structure according to claim 1, wherein the first bottom wall of the base plate has a hardness greater than that of the first lower shaft portion of the lifting mechanism.

4. The key structure according to claim 1, wherein the first upper shaft portion of the lifting mechanism and the first cap wall of the key cap both are formed of polymer.

5. The key structure according to claim 1, wherein a surface of the first lower shaft portion facing the first bottom wall has an abrasion loss, and the maintaining gap is greater than the abrasion loss.

6. The key structure according to claim 1, wherein the key cap further comprises a second cap wall, and an absolute value of a tolerance of a difference between the first cap wall and the second cap wall is smaller than the maintaining gap.

7. A lifting mechanism movably connected between a key cap and a base plate, so that the key cap reciprocates with respect to the base plate, wherein the lifting mechanism comprises: a pair of brackets relatively movable to each other, wherein the pair of brackets comprises a first upper shaft portion and a first lower shaft portion which are respectively movably connected on the same side of the key cap and the base plate; wherein when the key cap is in a released state, the first upper shaft portion presses against a first cap wall of the key cap, but the first lower shaft portion is separated from a first bottom wall of the base plate by a maintaining gap; wherein in a pressed state, the first lower shaft portion is separated from the bottom wall by a bottom wall gap, the first upper shaft portion is separated from the first cap wall by a cap wall gap, and the cap wall gap is smaller than the bottom wall gap.

8. The lifting mechanism according to claim 7, wherein the pair of brackets is pivotally connected to each other.

9. The lifting mechanism according to claim 7, wherein the first upper shaft portion and the first lower shaft portion are respectively movably connected on a first side of the key cap and the base plate; the pair of brackets further comprises a second upper shaft portion and a second lower shaft portion which are respectively pivotally connected on a second side of the key cap and the base plate, and the second side is opposite to the first side.

10. The lifting mechanism according to claim 7, wherein the pair of brackets comprises an inner lateral arm and an outer lateral arm which are pivotally connected in a pivotal direction, and the first lower shaft portion and the first upper shaft portion are located on the same side of the pivotal direction.

11. The lifting mechanism according to claim 10, wherein the pair of brackets further comprises a second upper shaft portion and a second lower shaft portion which are located on a side opposite to the same side of the pivotal direction.

12. The lifting mechanism according to claim 7, wherein a surface of the first lower shaft portion facing the first bottom wall has an abrasion loss, and the maintaining gap is greater than the abrasion loss.

13. The key structure according to claim 7, wherein the key cap further comprises a second cap wall, and an absolute value of a tolerance of the difference between the first cap wall and the second cap wall is smaller than the maintaining gap.

* * * * *